US005842589A

United States Patent [19]

Kröll et al.

[11] Patent Number: 5,842,589

[45] Date of Patent: Dec. 1, 1998

[54] CRANE, IN PARTICULAR RAILBOUND MOBILE CRANE

[75] Inventors: Joachim Kröll, Jüchen; Peter Richter, Bergheim; Manfred Dörre, Langenfeld, all of Germany

[73] Assignee: Mannesmann Aktiengesellshaft, Düsseldorf, Germany

[21] Appl. No.: 992,984

[22] Filed: Dec. 18, 1997

[30] Foreign Application Priority Data

Dec. 19, 1996 [DE] Germany ..... 196 54 521.8

[51] Int. Cl.[6] ..... B66C 23/04

[52] U.S. Cl. ..... 212/299; 212/231; 212/306

[58] Field of Search ..... 212/224, 226, 212/231, 299, 306, 325; 104/2, 3

[56] References Cited

U.S. PATENT DOCUMENTS 4,249,467 2/1981 Theurer et al. ..... 104/3

5,595,313 1/1997 Kroll et al. ..... 212/225

5,607,071 3/1997 Kroll et al. ..... 212/231

5,657,888 8/1997 Kroll et al. ..... 212/226

*Primary Examiner*—Thomas J. Brahan

*Attorney, Agent, or Firm*—Cohen, Pontani, Lieberman & Pavane

[57] ABSTRACT

A crane, in particular railbound mobile crane, with a luffing jib telescoping at both sides which can be swung up and down as well as raised and lowered with its base boom. The boom is supported in its end regions at the vehicle on a swivel bearing which can be raised and lowered. The luffing jib is swivelable about vertical axes in the region of the swivel bearings. For this purpose, every swivel bearing is supported at one of two separate multiple-axle traveling mechanisms so as to be displaceable traverse to the longitudinal axis of the mobile crane. The two traveling mechanisms are coupled with one another via the base boom of the luffing jib, which base boom is connected with the swivel bearings.

9 Claims, 5 Drawing Sheets

CRANE, IN PARTICULAR RAILBOUND MOBILE CRANE

BACKGROUND OF THE INVENTION

1. Field of the Invention

The invention is directed to a crane, in particular a railbound mobile crane, with a derricking jib or luffing jib telescoping at both sides which can be swung up and down as well as raised and lowered with its main boom or base boom. The jib is supported in its end regions at the vehicle on a swivel bearing which can be raised and lowered. The luffing jib is swivelable about vertical axes in the region of the swivel bearings.

2. Description of the Prior Art

Cranes of the above type are usually used as railroad cranes in railway and bridge construction. These cranes are characterized in that they can be maneuvered in confined spaces with large carrying loads. This is required especially when working on stretches adjoined by neighboring track or in tunnels where it is compulsory to maintain lateral distances and where, for this reason, no counterbalances can be moved out. The required high carrying force must also be maintained when the jib is extended, even when the jib is swiveled laterally for lateral hoisting of loads. On the other hand, the carrying load of a generic crane cannot be increased optionally, because an upper limit is generally imposed on the inherent weight of the vehicle and/or the inherent weight of the vehicle is restricted by regulations of the operators of the railroad line. This means that a reduction in the inherent weight of the vehicle can benefit an increase in the carrying load.

A mobile crane of the generic type is known from the European Patent Application 0665185 A1. The crane described in this European patent application comprises a base frame which extends along the length of the vehicle and rests at both ends on traveling mechanisms of multiple-axle rigid-axle traveling gear. The base boom of the telescoping luffing jib is accommodated in the region of its ends in swivel bearings which are supported at both ends of the vehicle frame and are substantially formed of piston-cylinder units by means of which the luffing jib can be raised and lowered. A hoist drive is provided at the center of the base boom for swinging the luffing jib in a vertical plane. The jib can be lifted by the hoist drive on one side or the other, as required, after one of the ends of the base boom has been bolted with the swivel bearing. Further, the luffing jib is laterally swivelable about vertical axes in the region of the swivel bearings in order to pick up and deposit loads adjacent to the track.

SUMMARY OF THE INVENTION

It is an object of the present invention to simplify a crane of the generic type in such a way that it can be built so as to be substantially lighter and, above all, can be manufactured more economically while still supporting the same heavy loads and with high stability and while retaining all of its functions.

Pursuant to this object, in the inventive crane every swivel bearing is supported at one of two separate multiple-axle traveling mechanisms so as to be displaceable traverse to the longitudinal axis of the mobile crane. The two traveling mechanisms are connected with one another via the base boom of the luffing jib, which base boom is connected with the swivel bearings.

The basic idea of the invention is that the vehicle frames extending along the entire length of the vehicle which were previously compulsorily required are dispensed with and only two separate multiple-axle traveling mechanisms are provided which are connected with one another via the base boom of the luffing jib. In this way, considerable savings in weight can be achieved in the manufacture of such a crane without negatively affecting the carrying capacity of the crane. The swivel bearings are further constructed so that they can be raised and lowered and are capable of raising and lowering the base boom of the luffing jib parallel to its longitudinal extension as well as producing an inclination of the luffing jib by raising and/or lowering one of the swivel bearings on one side.

The lateral slewing of the luffing jib is effected by displacing one of the swivel bearings transversely to the longitudinal axis of the vehicle. Changes in spacing between the two chassis or traveling mechanisms due to the lateral swinging out of the luffing jib can be compensated for in that the traveling mechanism whose swivel bearing forms the vertical swivel axis for the luffing jib is movable without braking and accordingly carries out the longitudinal compensation automatically.

In a further embodiment of the invention, the drive units and supply units of the mobile crane are arranged in a housing which is suspended at the underside of the base boom between the traveling mechanisms.

Whereas in conventional mobile cranes of the generic type, the supply units and the drives of the crane are arranged on the base frame of the vehicle, these units are suspended below the base boom in the housing, in the crane according to the present invention. This housing swings together with the luffing jib and advantageously serves at the same time as ballast for the jib.

According to another embodiment of the invention, in order to ensure the lateral swiveling capability of the luffing jib, each swivel bearing is supported on a carriage or slide which is movable or displaceable on running rails which can slide out laterally transverse to the vehicle. These running rails are slid into corresponding guides at the traveling mechanism frame while the crane is transported, and are moved out on the side of the crane facing the load as soon as the crane is brought into its working position. The running rails can be designed as stable H-girders in order to achieve a high resistance to bending and torsion.

According to still another embodiment of the invention, the running rails are guided so as to be supported at the traveling mechanism in prismatic guides and are provided with supporting elements at their free ends. The prismatic guides allow a reliable support bearing of the ends of the running rails which remain in the guides also in the moved out state and accordingly make it possible to absorb high tilting moments. The supporting elements at the free end of the running rails can remain at the vehicle in the moved in transporting state of the running rails, so that setup times for the crane according to the invention are extremely short.

In yet a further embodiment of the invention, at least two rails can be moved out on each side of the vehicle, these rails being connected with one another in the region of their free ends by a crosspiece to which are fastened, as supporting elements, two pressure-regulated piston-cylinder units having vertically extensible piston rods and supporting plates articulated at these piston rods. The running rails on opposite sides of the vehicle are arranged in a common plane, but are offset laterally relative to one another in their longitudinal extension. The piston-cylinder units serving as support means are conventional components known to those skilled in the art. The essential feature of the present construction is simultaneous use of the running rails as jibs for support purposes and as a traveling path for the slides receiving the swivel bearings.

According to the invention, the piston-cylinder units are articulated at a shared support plate on the piston rod side which, owing to the articulation, is capable of compensating for small inclined positions of the support plate.

Every slide is preferably clamped at the running rails in a positive engagement so as to be displaceable in the vertical direction transverse to the vehicle. Although the weight of the luffing jib with the swivel bearings supported on the vehicle is very high, the clamping of the slide ensures nevertheless that the slide will not be lifted from the running rails when heavy loads are hoisted, but rather that the slide is guided faultlessly at these running rails.

An essential requirement for proper, dependable functioning of a crane vehicle according to the invention is an exact horizontal alignment of the vehicle during crane operation. In cranes, and especially in railbound mobile cranes, inclined positions of the vehicle frequently result in that the traveling path or rails are excessively raised along curved stretches. In such a case, means for compensating for inclination must be provided for the vehicle at the traveling mechanism so that those parts of the traveling mechanism frame on which the swivel bearing support of the base boom and of the slides are supported can be restored to the horizontal. For this reason, according to a further feature of the invention, each traveling mechanism is provided with inclination compensation for the horizontal alignment of the vehicle so that each traveling mechanism frame part receiving the swivel bearing of the base boom is supported relative to the traveling mechanism frame part receiving the wheel sets so that it is articulated so as to be tiltable on all sides. Furthermore, the two traveling mechanism frame parts are connected with one another via piston-cylinder units.

In order to realize an advantageous design of the inclination compensation according to a further embodiment of the invention, the traveling mechanism frame part receiving the swivel bearing support of the base boom is provided in the longitudinal direction on both sides with pivots which project down vertically and which are supported so as to be articulated on all sides in abutments arranged directly above the rail plane at the traveling mechanism frame parts receiving the live rings. In this way, the fulcrum for the inclination compensation can be situated low enough so that it comes as close as possible to the optimum position in the rail plane.

The invention provides a crane, particularly a railbound mobile crane, which is distinguished by low weight with high carrying loads. Due to the fact that a base frame extending along the entire length of the vehicle is dispensed with, the crane can not only be designed much lighter, but it also has a simpler construction and is accordingly more economical to manufacture. The novel support of the crane in connection with the stewing drive of the luffing jib is relatively simple and easy to manufacture. The traveling rails used for the slides of the swivel bearings do not require any curvature to follow the swivel radius of the luffing jib, but rather can extend in a straight line and can accordingly be slid in the region of the vehicle and transported together with the vehicle.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
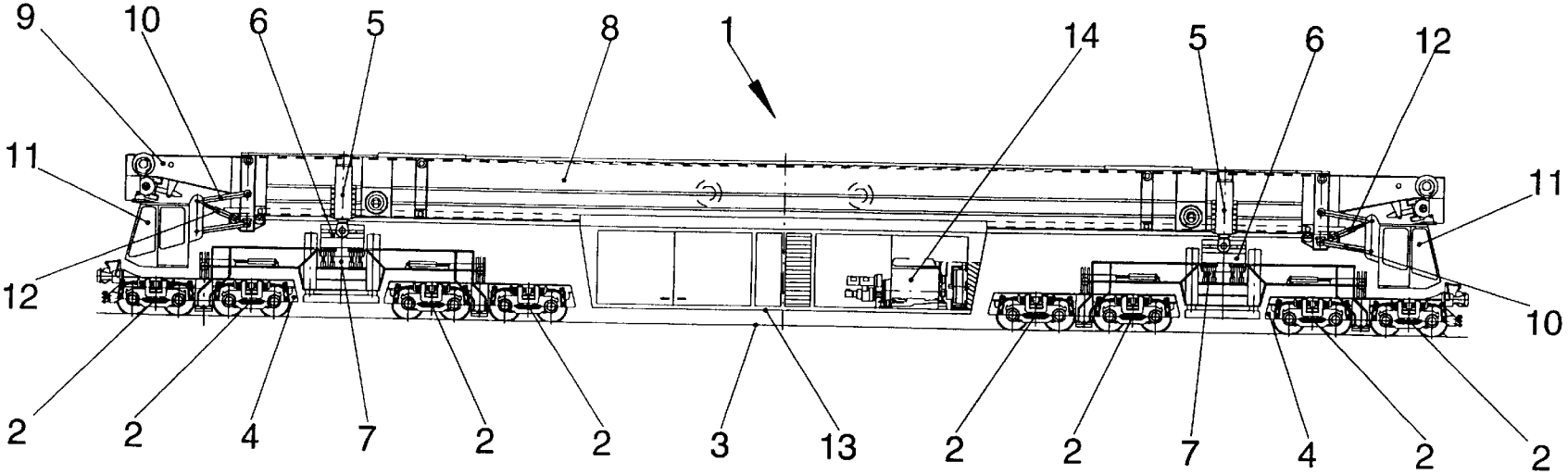
FIG. 1 is a side view of a railbound mobile crane according to the invention.

In FIG. 1, the railbound mobile crane 1 and is movable on rails 3 by means of rigid-axle running mechanisms. Four wheel sets 2 comprise a multiple-axle traveling mechanism 4, one of which wheel sets 2 is provided at the front end of the mobile crane 1 while the other is provided at the rear end of the mobile crane 1. Each of these traveling mechanisms 4 supports a swivel bearing 5, which is supported, in turn, on a slide 6 and is displaceable perpendicular to the drawing plane on rigid running rails 7. The swivel bearings 5 are arranged on an axis 15 and are fastened to a base boom 8 of the luffing jib, enabling its slewing motion. The base boom 8 produces the sole connection between the traveling mechanisms 4. The telescoping jib 9 is guided in the base boom 8 so as to telescope at both sides and receives load fastening means at its cantilevering end. An operator's cabin 11 is provided below the telescoping jib 9 projecting out of the base boom and above a parallelogram lever system 10 at each side of the mobile crane 1 and can be raised and lowered by hydraulic cylinders 12 associated with the parallelogram levers 10. The hydraulic cylinders 12 make it possible to raise the operator's cabin 11 for lowering the base boom 8 while the mobile crane 1 is being transported. A housing 13 which accommodates all of the drive units and supply units 14 for the entire vehicle is provided at the lower side in a central region of the base boom 8. The housing 13 is suspended at the base boom 8 and serves at the same time as a ballast for the luffing jib.

The swivel bearings 5 are simultaneously constructed as piston-cylinder units which are arranged at both sides of the base boom 8 and make it possible for the base boom 8 to be raised and lowered.

Figure 2:
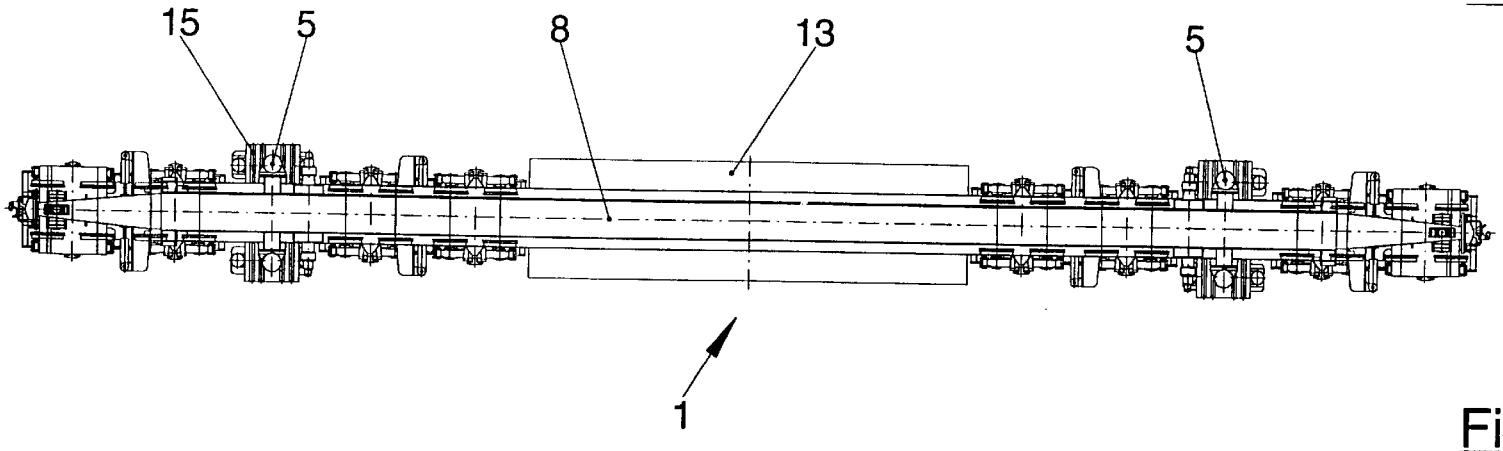
FIG. 2 is a top view of the mobile crane according to FIG. 1.

It can be seen from FIG. 2, which shows a top view of the crane according to FIG. 1, that the running rails 7 are provided in the region of the swivel bearings 5. The swivel bearings 5, which are supported on the slide 6, are displaceable on these running rails 7. By displacing one slide 6 with the swivel bearing 5 while simultaneously fixing the other slide 6 with the other swivel bearing 5 on the running rails 7, an inclined position of the base boom 8 can be achieved relative to the longitudinal axis of the vehicle in order to enable work to be carried out adjacent to the track rails 3 .

Figure 3:
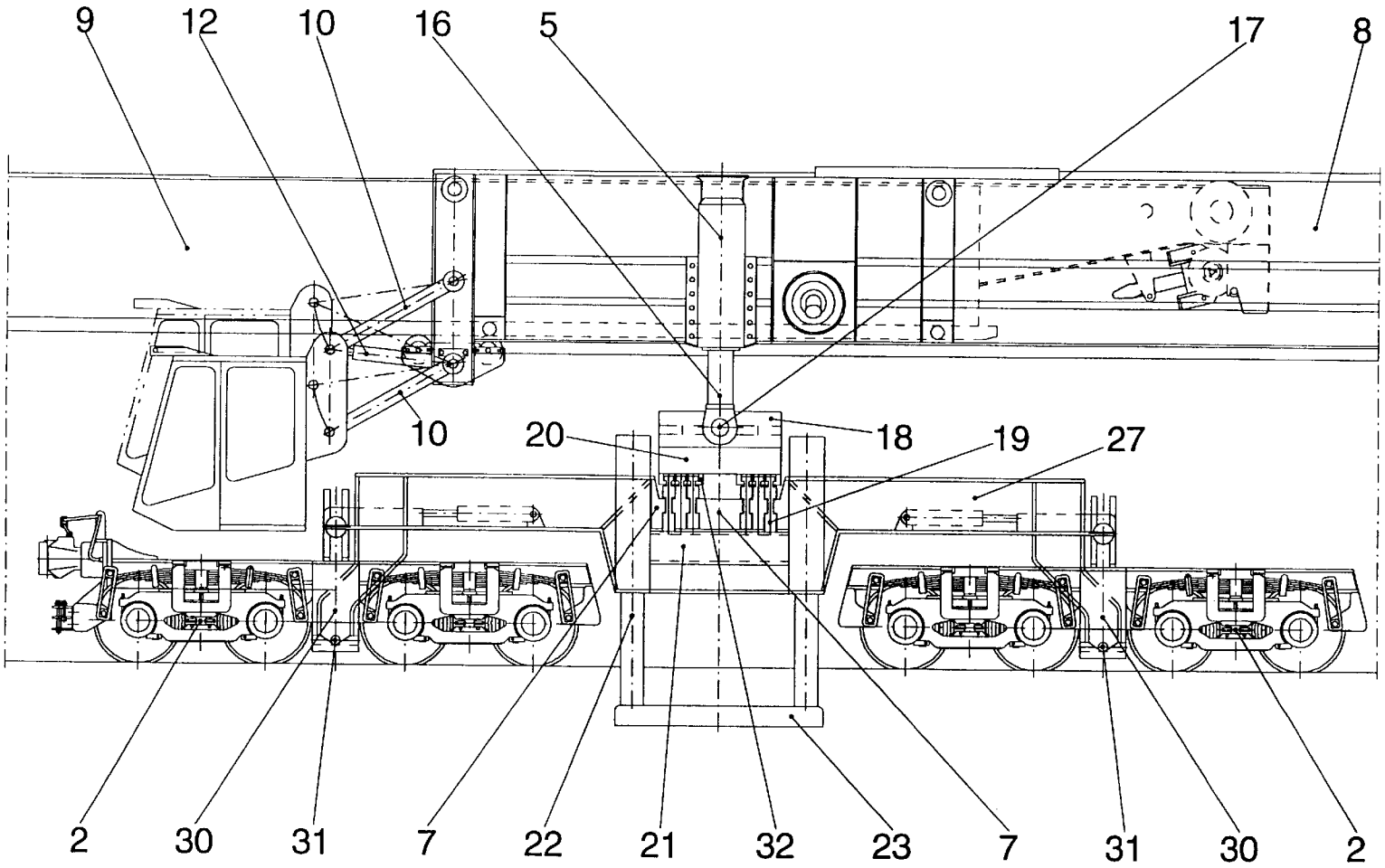
FIG. 3 is a side view of the mobile crane according to FIGS. 1 and 2 in the region of a swivel bearing.
Figure 4:
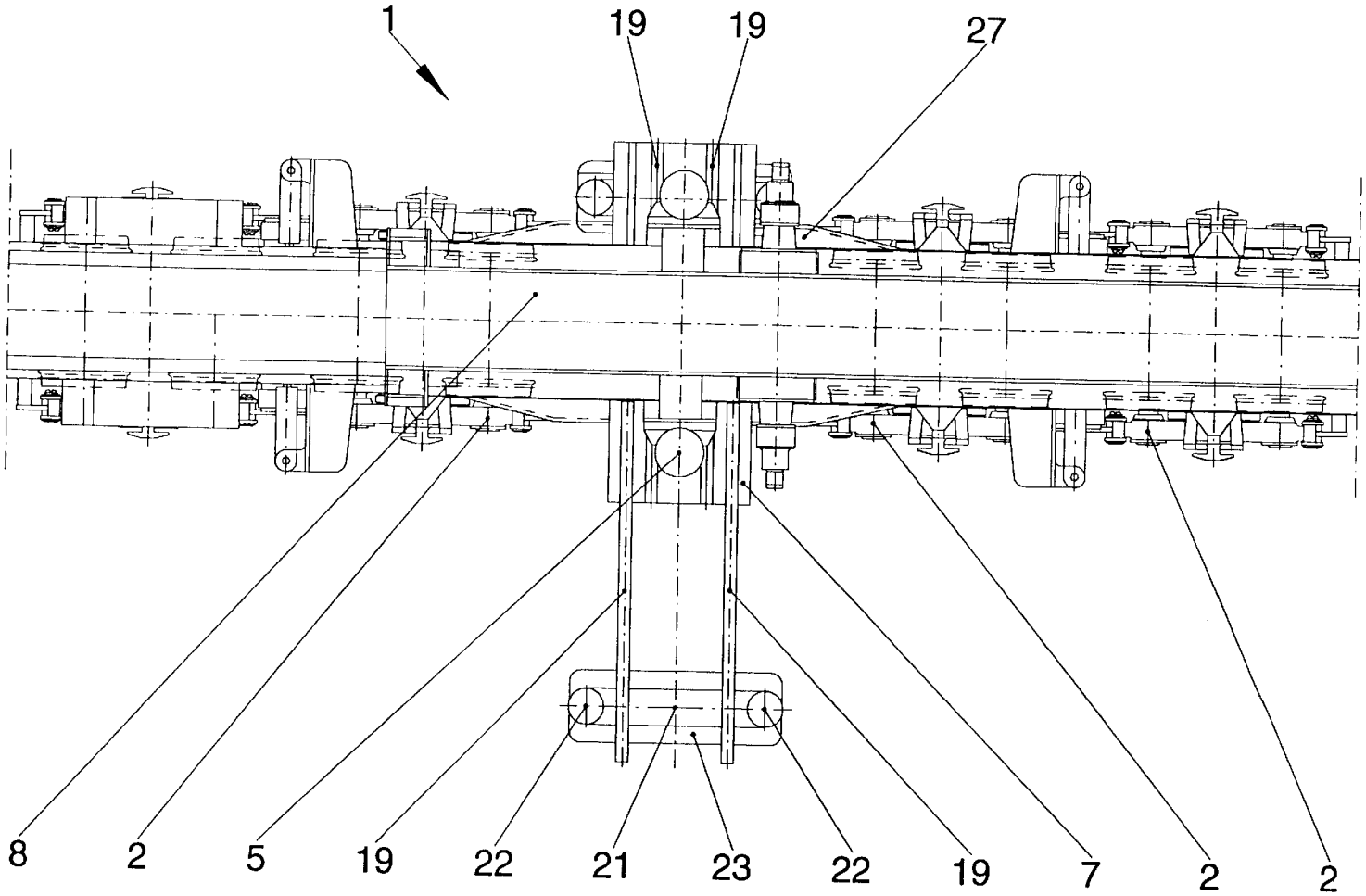
FIG. 4 is a top view of FIG. 3.

FIG. 3 shows an enlarged view of the region of the swivel bearing 5 in which the base boom 8 is supported. This Figure shows one of the piston-cylinder units by means of which the swivel bearing 5 for the base boom 8 can be raised and lowered. The piston rod 16 of the piston-cylinder unit is articulated at an upper part 18 of the slide at 17. The upper part 18 is displaceable perpendicular to the drawing plane on the extensible running rails 19. In order to generate the required supporting width of the mobile crane, the extensible running rails 19 can be slid out of the traveling mechanism frame part 27 on the side of the mobile crane facing the load, as is shown in FIG. 4. The extensible running rails 19 on both sides of the mobile crane 1 are arranged in a common horizontal plane, but so as to be offset adjacent to one another, and can be completely slid in within the outline or contour 26 of the mobile crane. Two vertically acting piston-cylinder units 22 are connected via a cross-piece 21 at the free ends of the extensible running rails 19. A support plate 23 is commonly carried by the piston-cylinder units 22 at the piston rod ends.

Figure 5:
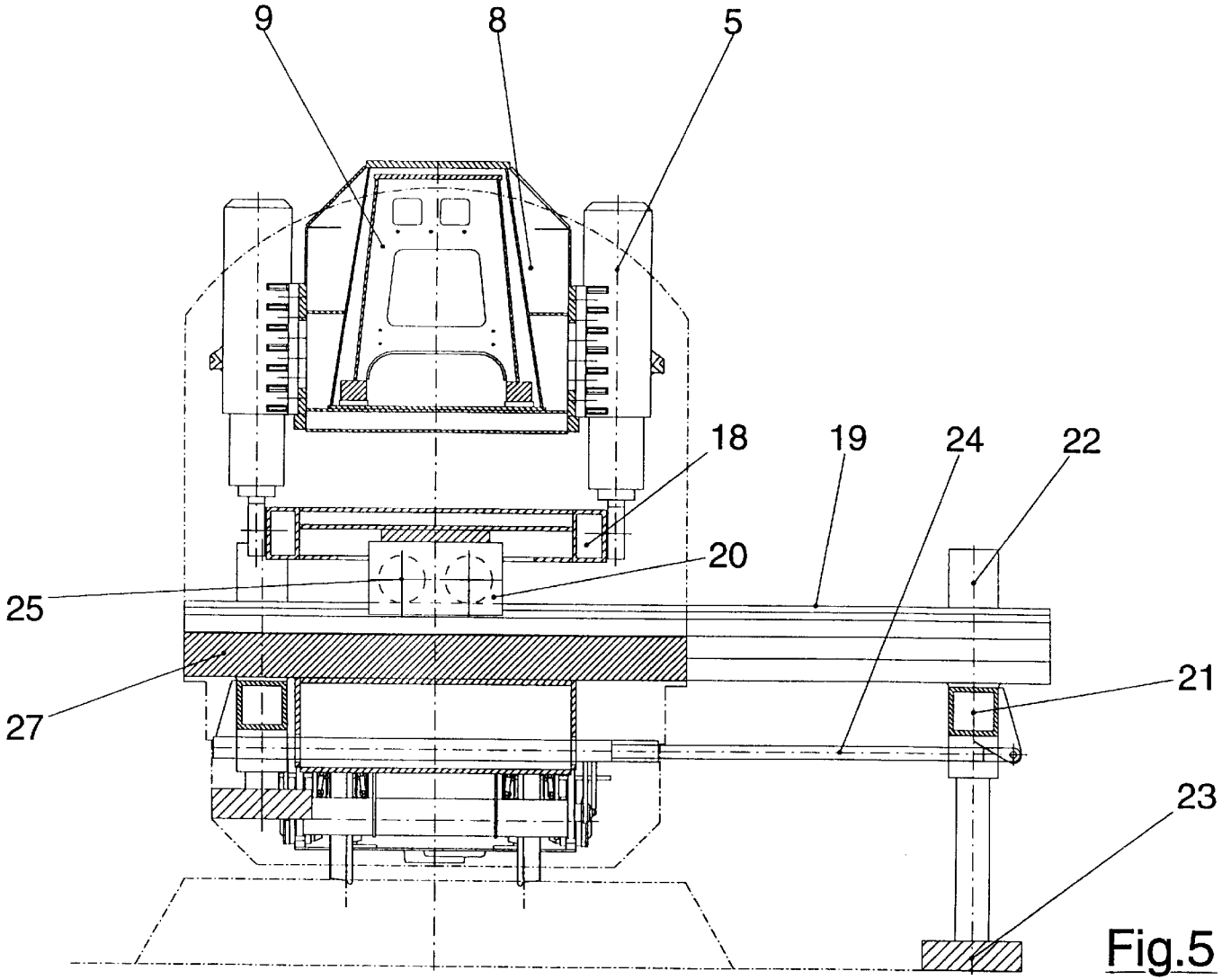
FIG. 5 is a cross section through the mobile crane in the region of the swivel bearing with support.

As can be seen more clearly from FIG. 5, the running rails 19 are moved in and out via a piston-cylinder unit 24. The support plate 23 can be locked in the raised position for transporting. In the supported position shown in the FIG. 5, the lower slide part 20 of the slide 6 can be moved via rollers 25 which are guided on the extensible running rails 19, wherein the base boom 8 is adjusted transverse to the longitudinal axis of the vehicle with the telescoping part 9 forming the luffing jib when the swivel bearing 5 remains in its position at the other end of the base boom 8.

Figure 6:
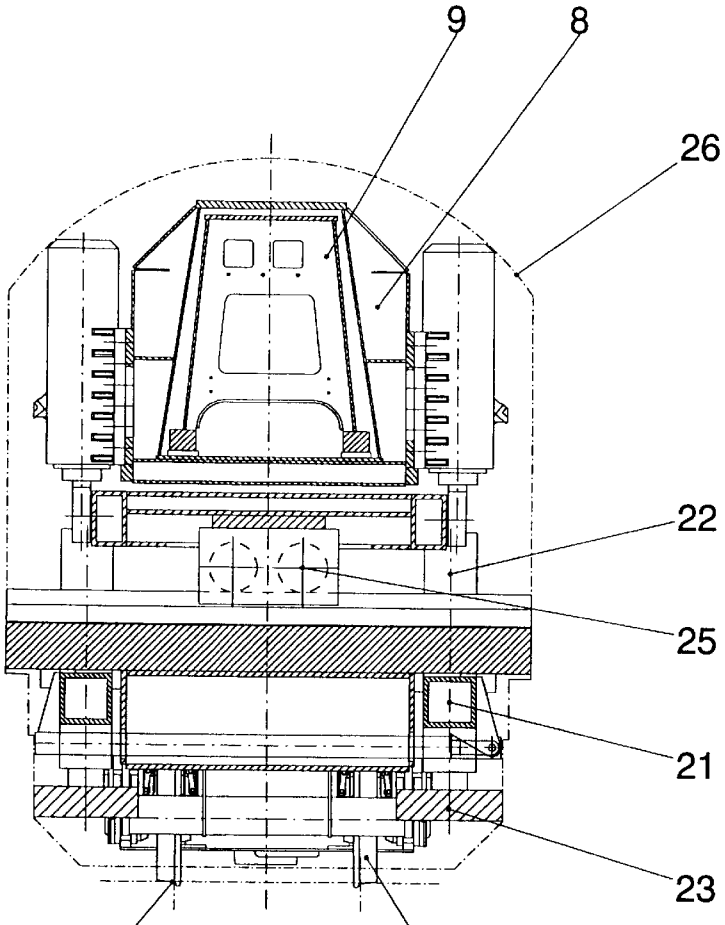
FIG. 6 is a cross section through the mobile crane in the region of the support in the transporting position.

The entire supporting system is moved in within the clearance 26 of the crane vehicle as can be seen in cross section in FIG. 6.

Figure 7:
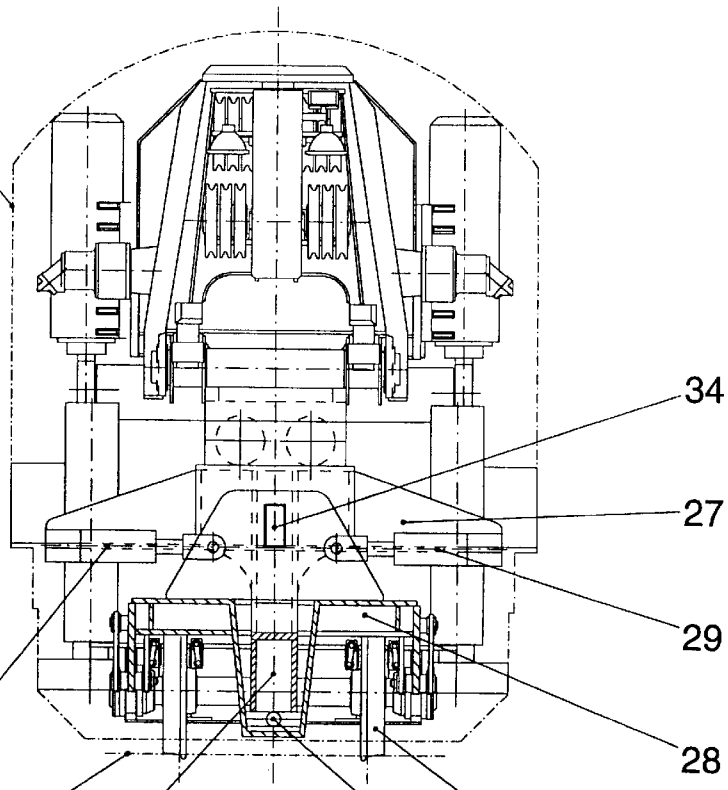
FIG. 7 is a cross section through the mobile crane in the region of the inclination compensation.

FIG. 7 shows how the inclination compensation of the mobile crane is brought about. For this purpose, the traveling mechanism frame part 27 receiving the swivel bearing support of the base boom 8 is connected, via the piston-cylinder units 29, with the traveling mechanism frame part 28 receiving the wheel sets 2. The first frame part 27, as can be seen in FIG. 3, is provided at its two ends with angled pivots 30 which project downward and are supported in a three-dimensional abutment 31 arranged directly above the plane of the tracks 3. Before putting the inclination compensation into effect, a locking bar 34 supported in the traveling mechanism frame part 27 is pulled out of the traveling mechanism frame 28 by means of hydraulic cylinder 33 (FIG. 3) and cancels the locking of the traveling position. By actuating the piston-cylinder units 29 in the opposite direction, the traveling mechanism frame part 27 can be inclined relative to the traveling mechanism frame part 28 transverse to the longitudinal direction of the vehicle so that, when the rigid-axle running mechanisms 2 rest at an inclination on the rails 3, a horizontal alignment of the traveling mechanism frame part 27 receiving the swivel bearing support of the base boom is enabled. In this way, the extensible running rails 19 along with the entire supporting arrangement can remain horizontal even when the traveling mechanisms are in an inclined position, wherein the low abutment point of the pivot 30 is particularly advantageous.

As can be seen most clearly from FIG. 3, every slide 6 is clamped at the running rails 7, 19 via groove connections 32 in order to prevent a vertical lifting of the slide 6 from the running rails 7, 19 also when a tilting moment acts on the slide 6 as a result of large loads.

The invention is not limited by the embodiments described above which are presented as examples only but can be modified in various ways within the scope of protection defined by the appended patent claims.

We claim:

1. A crane, comprising:

a luffing jib configured to telescope at both ends, and having a base boom, the luffing jib being swingable up and down as well as raisable and lowerable with the base boom;

a swivel bearing respectively provided at each end of the base boom, each swivel bearing being raisable and lowerable, the luffing jib being swivelable about vertical axes in a region of the swivel bearings; and two multiple-axle traveling mechanisms, each swivel bearing being supported at one of the traveling mechanisms so as to be displaceable traverse to a longitudinal axis of the crane and so that the two traveling mechanisms are connected with one another by the base boom of the luffing jib.

2. A crane, according to claim 1, and further comprising a housing suspended at an underside of the base boom between the traveling mechanisms, and drive units and supply units arranged in the housing.

3. A crane, according to claim 1, and further comprising for each swivel bearing, running rails arranged on the travel mechanisms so as to be slidable in and out laterally transverse to the longitudinal axis, and slides displaceable on the running rails, each swivel bearing being supported on a respective one of the slides.

4. A crane according to claim 3, and further comprising prismatic guides mounted on the traveling mechanisms, the running rails being supported in the prismatic guides, and supporting elements provided at free ends of the running rails.

5. A crane according to claim 4, wherein the running rails include two groups of running rails that can be moved out on each side of the base boom, the running rails having free ends, and further comprising a respective cross piece arranged on each side of the base boom to connect together the free ends of the running rails, the supporting elements including two pressure-regulated piston-cylinder units connected to the cross piece and having vertically extensible piston rods, and supporting plates articulated at the piston rods.

6. A crane, according to claim 5, wherein the piston-cylinder units are articulated at a shared supporting plate on ends of the piston rods.

7. A crane, according to claim 3, and further comprising means for positively clamping the slides at the running rails so that the slides are displaceable transverse to the longitudinal axis of the crane.

8. A crane, according to claim 1, wherein the traveling mechanisms each include a first frame part and a second frame part, and further comprising wheelsets mounted to the second frame part of each of the traveling mechanisms, and inclination compensation means for each traveling mechanism for compensating for inclination and horizontally aligning the crane, the inclination compensation means including a bearing mounted on the first frame part to receive the swivel bearing of the base boom relative to the second frame part receiving the wheel sets, the bearing being articulated so as to be tiltable on all sides, and further comprising piston-cylinder units arranged to connect together the first and second frame parts.

9. A crane, according to claim 8, wherein the first frame part receiving the swivel bearing of the base boom is provided, in the longitudinal direction of the crane, on both sides of the longitudinal axis, with pivots which project downward vertically and are supported so as to be articulated in the bearing arranged directly above a rail plane at the second frame part receiving the wheel sets.

* * * * *